United States Patent [19]

Pasqualini

[11] 4,270,866

[45] Jun. 2, 1981

[54] PLATEN POSITIONING ATTACHMENT FOR TYPEWRITERS FOR TYPEWRITING MUSICAL NOTATION

[76] Inventor: Guido Pasqualini, Piazza San Paolo 6, Albano Laziale, Italy

[21] Appl. No.: 905,134

[22] Filed: May 12, 1978

[30] Foreign Application Priority Data

May 20, 1977 [IT] Italy ..... 49491 A/77

[51] Int. Cl.[3] ..... B41J 3/34

[52] U.S. Cl. ..... 400/117; 400/20; 400/490; 400/571

[58] Field of Search ..... 400/20, 117, 571, 295, 400/298, 490

[56] References Cited

U.S. PATENT DOCUMENTS

| | | | |
|---|---|---|---|
| 432,298 | 7/1890 | Blickensderfer | 400/20 |
| 650,447 | 5/1900 | Beals | 400/117 |
| 659,587 | 10/1900 | Irish | 400/298 X |
| 668,571 | 2/1901 | Barron | 400/295 X |
| 950,543 | 3/1910 | Schneeloch | 400/20 X |
| 1,074,858 | 10/1913 | Groyen | 400/117 |
| 1,225,369 | 5/1917 | Simpson | 400/20 |
| 1,251,922 | 1/1918 | Rivera | 400/117 |
| 1,311,921 | 8/1919 | Simpson | 400/20 |
| 1,604,647 | 10/1926 | Lucas | 400/117 |
| 1,827,451 | 10/1931 | Aillaud | 400/117 |

FOREIGN PATENT DOCUMENTS

| | | | |
|---|---|---|---|
| 555947 | 8/1932 | Fed. Rep. of Germany | 400/117 |
| 264837 | 5/1929 | Italy | 400/117 |
| 1267378 | 3/1972 | United Kingdom | 400/117 |

*Primary Examiner*—Ernest T. Wright, Jr.

*Attorney, Agent, or Firm*—Silverman, Cass & Singer, Ltd.

[57] ABSTRACT

An attachment for installation upon a typewriter for applying musical notations to a sheet material and comprising a frame pivotally mounted on the typewriter body, the frame including a bridging member at one end of the frame adjacent the platen of the typewriter and a secondary keyboard at the opposite end of the frame. The bridging member carries rotatable, axially parallel cylindrical members spaced along the length thereof and oriented generally vertically to engage plural rollers oriented axially parallel to the platen and engaged thereagainst. The secondary keyboard carries individual keys, each having depending stems selectively engageable with a spring biased lever when a selected one of said keys is depressed. The keys each represent an imprinting location on a musical staff for application of the musical characters controlled by the principal keyboard of the typewriter. Depression of a selected one of the secondary keys causes movement of the spring biased lever to pivot the frame a given degree, raising the cylinders a predetermined height and thus causing rotation of the rollers whereby to rotate the platen (and the sheet guided thereby) incrementally to place the imprinting location for reception of a musical character imprint at such location relative a musical staff as required by the operator.

6 Claims, 7 Drawing Figures

PLATEN POSITIONING ATTACHMENT FOR TYPEWRITERS FOR TYPEWRITING MUSICAL NOTATION

The present invention relates to attachments for installation on typewriters for enabling musical notation including notes and musical signs to be typewritten.

Referring to the drawing.

Figure 1:
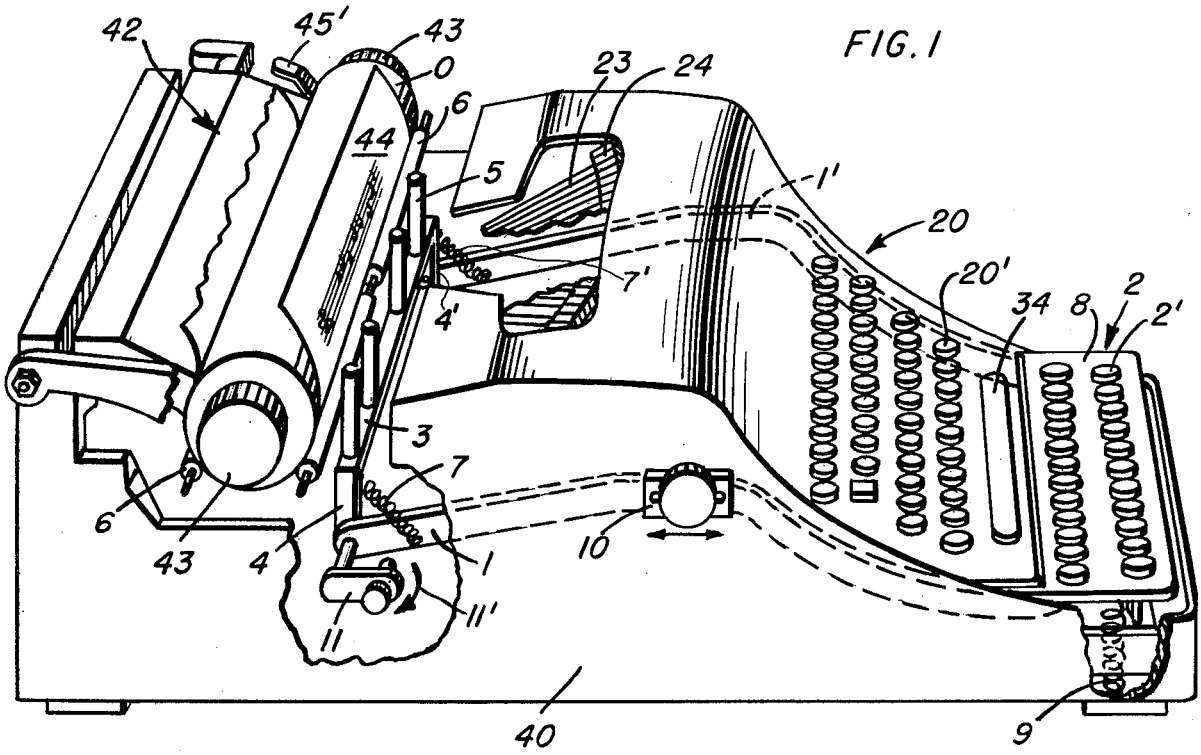
FIG. 1 is a perspective view of a typewriter having the attachment for typewriting musical notations according to the invention operably installed as a part thereof.
Figure 3:
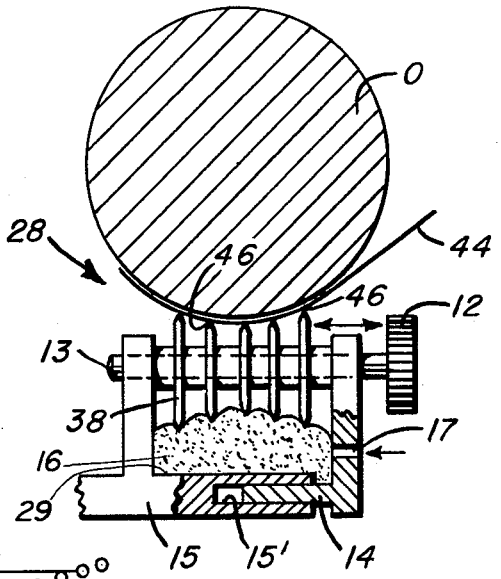
FIG. 3 is an enlarged sectional detail of a musical staff scribing attachment arranged in such relationship with the platen as to enable scribing of a musical staff upon a sheet material.
Figure 4:
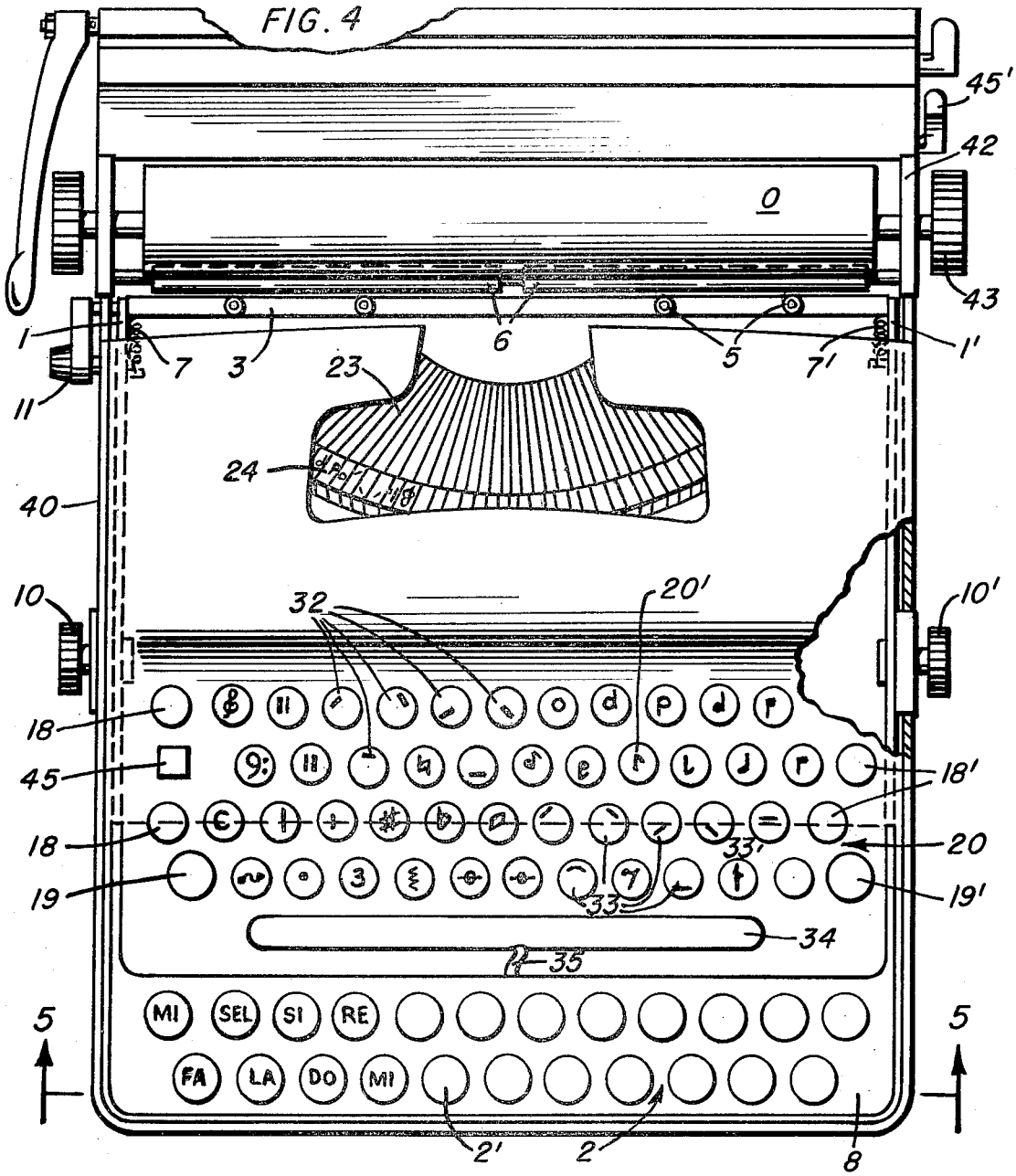
FIG. 4 is a plan view of the typewriter of FIG. 1, nonpertinent portions thereof being deleted.

As illustrated in FIGS. 1 and 4, the invention is intended for installation on a typical known typewriter which includes standard elements and features well known in the art, such as a typewriter body 40, a carriage 42 seated in the typewriter body 40 for stepwise horizontal movement relative thereto, a rotary platen 0 seated on the carriage 42 and defining a nip 46 (FIG. 3) therebetween, the platen 0 adapted for horizontal movement with the carriage 42 and for independent rotary movement relative to the carriage 42. A sheet 44 is fed through the nip 46 by rotating the platen 0. A primary keyboard 20 controls individual type bars 23 operably controlling the application of character type font 24 to the sheet material 44 at an imprinting location thereon. Stepwise horizontal movement of the carriage 42 and platen 0 therewith is effected with each operation of a selected primary key 20′ or the spacer bar 34. Knob 43 provided on conventional typewriters can be rotated stepwise to rotate the platen 0 and ordinarily can be manipulated, as by pulling same outward, to disengage said platen 0 so that selectively, the platen 0 can be rotated freely, independent of the stepwise rotation means. Conventional tab key 45 and/or carriage release lever 45′ can be manipulated to permit the platen 0 and the carriage 42 to move horizontally together. These mechanisms are provided as a part of conventional typewriters.

The attachment according to the invention is illustrated in FIG. 1 and comprises a frame formed of a pair of spaced, parallel rods 1 and 1′ supporting a musical keyboard 2 on a plate 8 and, on the opposite end, supporting an inverted U-shaped rod 3 having a pair of depending arms 4 and 4′. Rod 3 carries plural, generally upstanding rods or cylinder 5 arranged vertically oriented and spaced along the length of the rod 3. Preferably, the cylinders 5, may be slightly cambered. The cylinders 5 are rotatably mounted for rotation about their axes so as to be non-interferent with the horizontal shifting of platen 0.

A pair of compression springs 7 and 7′ are connected between the rods 1,1′ and the arms 4,4′. The springs 7 and 7′ serve to bias the rod 3 and small cylinders 5 toward small rollers 6 so as to urge sheet material 44 such as paper against the platen 0.

The rods 1 and 1′ are mounted releasably on the typewriter body 40 fulcrumed about adjustable mountings 10 and 10′. The musical keyboard 2 comprises a plurality of keys 2′, each having depending stems 25 which are capable of engaging lever 22.

As soon as one depresses one key 2″ of the keys 2′ of the musical keyboard 2 (as shown at X in FIG. 6) the plate 8 and all the stems 25 are depressed; at the other end, rods 1,1′, rod 3 and the small cylinders 5 are raised. When cylinders 5 are raised, they engage the rollers 6 tangentially to cause the front small feed rollers 6 to rotate about their axes whereby to rotate the platen 0 about its axis incrementally.

The angular rotation of platen 0 is determined by the length of travel required to cause the depressed key 2″ to rest with its stem 25 upon the inclined lever 22 which is located below the musical keyboard 2. Music manuscript paper 44 carrying staff diagrams 26 is fed into the nip 46 of the typewriter and moved with rotation of the platen 0. The specific location on each staff diagram 26 printed on the manuscript paper 44, at which the musical character is to be written is determined by angular rotation of the platen 0 caused by the depression of the proper one key 2″ of keys 2′.

The operator places the platen 0 in freely rotatable condition so that rotation is controlled by manipulation of a selected one of the keys 2′ of the keyboard 2.

Figure 7:
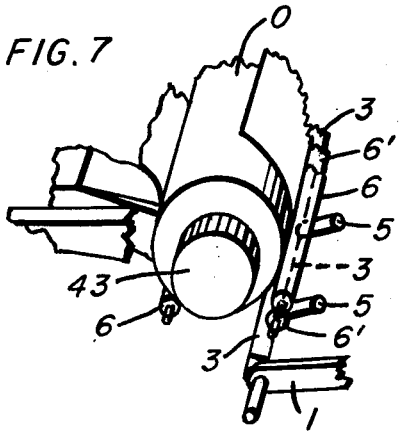
FIG. 7 is a fragmentary perspective view of a typewriter having another embodiment of a portion of the attachment for typewriting musical notations according to the invention operably installed as a part thereof.

Certain typewriters prevent the small rollers 6 from being rotated by the cylinders 5 because they do not extend enough, or because a conventional retainer or paper hold down bar overlies the carriage 42. In such instances, as seen in FIG. 7, an additional rollers 6′ must be provided located spaced from front feed rollers 6 and below platen 0. It will be understood that upward movement of rod 1, as seen in FIG. 7, moves rod 3 upward carrying cylinders 5 therewith whereby the roller 6′ is rotated by frictional engagement with cylinders 5, and roller 6 is rotated by being in frictional engagement with roller 6′ whereby platen 0 is rotated.

Other mechanisms for enabling the pivoting of plate 8 to effect the rotation of platen 0 may be provided.

A pair of lateral springs 9 are employed to return the plate 8 and keys 2′ to their initial position, springs 9 as shown being compression type springs.

Lever 11 enables rod 3 and its cylinders 5 to be offset from platen 0 if required in order to typewrite the words; that is, when the lever 11 is rotated in the direction of the arrow 11′, rod 3 is moved out of the path taken by the type levers 23.

Figure 2:
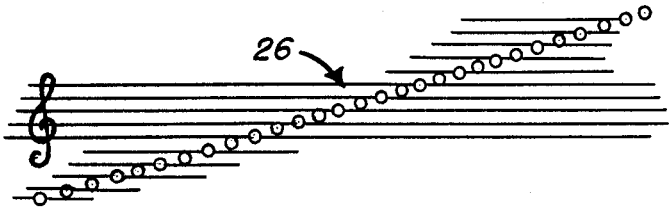
FIG. 2 is a representation of a musical staff having musical notation such as signature and notes inscribed thereon.

FIG. 2 represents a musical staff diagram 26 illustrated with the musical notation representing the musical key in the range of a violin along with several adjunctive lines above and below the staff diagram 26. Where the typewritten musical notation is substantial representing a considerable range of musical notes, a typewriter carrying many keys 2′ is required. With 28 keys 2′ and the intitial position, the operator has 29 selectable positions at which to position the platen 0. This covers four octaves.

FIG. 3 represents a scribing aparatus 28 for use at or along the platen 0 if one wishes to typewrite musical notation on staffs of different height. The scribing apparatus 28 enables scribing of staff notation conventional having the 5 lines thereof located at various distances apart, where desired. This scribing apparatus 28 can be detachably secured to the typewriting machine. It is sufficient that one can manually place apparatus 28 over the platen 0 with one hand and with the other move the carriage 42 to the left or to the right to scribe the staff diagram 26 on blank paper sheet 44 by manipulating the carriage release lever 45' of the typewriter.

Handgrip 12 is used for rotating shaft 13 to rotate five small wheels 38 mounted thereon across an inking pad 16 comprising a resilient material, such as felt or sponge within a well 29 defined by stationary member 15 and member 14 seated for slidable movement within slot 15' of member 15. The wheels 38 can be urged against pad 16, inking same and causing the wheels 38 to scribe the pattern representing the five line staff diagram 26 on the sheet 44. Wheels 38 have different relative diameters so as to effect good contact with the paper sheet 44 backed up by the platen 0. Inking occurs automatically via the pad 16. Inking port 17 is provided to enable reinking every few days.

The scribing apparatus 28 may be provided with five wheels 38 of equal diameter so that one can imprint the staff diagram 26 upon a paper sheet 44 when the paper sheet 44 rests flat on a table (not shown) outside the typewriter.

Referring now to FIG. 4 one can see the disposition of different musical notations, i.e., the notes and the musical signs, applied to keys 2', 20' of the keyboard 2, 20.

The 43 keys of an ordinary typewriter are sufficient to enable the typewriting of all of the musical notes and signs required by the musician for understanding of the composition. It is better if there are a few extra keys for additional musical notations as may be desired.

The reference characters 18, 18', 19 and 19' indicate the keys of the primary keyboard 20 which are required to effect known typewriter movements, e.g. back spacing, case shifting, etc. The numeral 45 designates a conventional tab key which when depressed conventionally releases the carriage 42 so as to apply the five lines of the staff diagram 26 by movement of the carriage 42 and associated platen 0 thereby operating the five wheels 16.

The thick lines carried on the keys 32 are used to bridge or otherwise join the stems of stemmed notes to provide the 8th and 16th notes, etc. The thin lines carried by keys 33 are applied to the stems of notes or to group notes according to the time desired.

The heavy lines on keys 32 and the thin lines on keys 33 are angled so that one can join the notes which have the stems thereof directed upward and join or group the notes having their stems directed downward.

When one applies the notes for chords or adds commas to 8th notes or desires to prolong the vertical lines in the same vertical place, the spacer bar 34 is held down using clamp 35 in order for carriage 42 and platen 0 to be immobilized. Holding down the spacer bar 34 in a manual typewriter prevents horizontal movement of the carriage 42 until the bar 34 is released. Then one rotates the platen 0 up and down manually and places the platen 0 and paper 44 so that the location to be occupied by the notes or the musical signs is adjusted and a selected one of keys 2' of the keyboard 2 is depressed.

The primary keys in the primary keyboard 20 in FIG. 4 are designated 20', but are spaced closer than normal to enable a greater number to be accommodated than found on the ordinary typewriter. As many as 28 or 29 keys can be appropriately provided.

Figure 5:
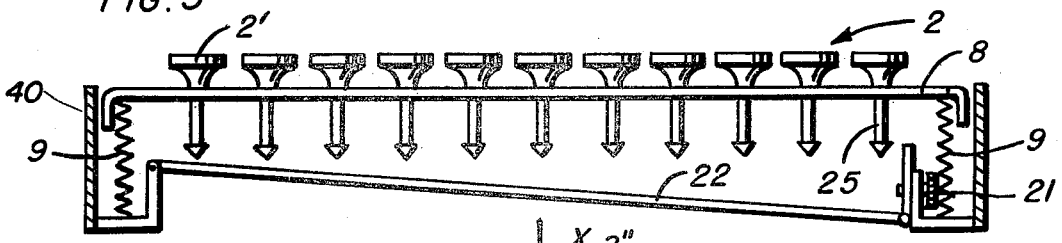
FIG. 5 is a sectional view taken along line 5—5 of FIG. 4 and in the direction indicated.

The actual metallic type for typewriting musical notations are about 13 m/m in height; the notes being about 1.70 m/m in breadth. The musical signs must be at the center of the characters. The rods or stems of the notes must have a length about 6 or 7 m/m. The thick lines should be about 0.75 m/m in thickness. Accordingly, the musical notation can be typewritten on staffs 6, 7, 8 m/m in height. FIG. 5 illustrates a line of keys 2' the stems 25 of which are the same length. When depressed, the keys rest on an inclined lever 22, the inclination of which is regulated by a screw 21. It is evident that the more the lever 22 is lowered, the longer its course and the greater the travel upward of cylinders 5. The greater the upward travel of the cylinders 5, the greater the angular rotation of the platen 0. This enables the typewriting of musical notations upon a staff diagram 26 of various heights.

Figure 6:
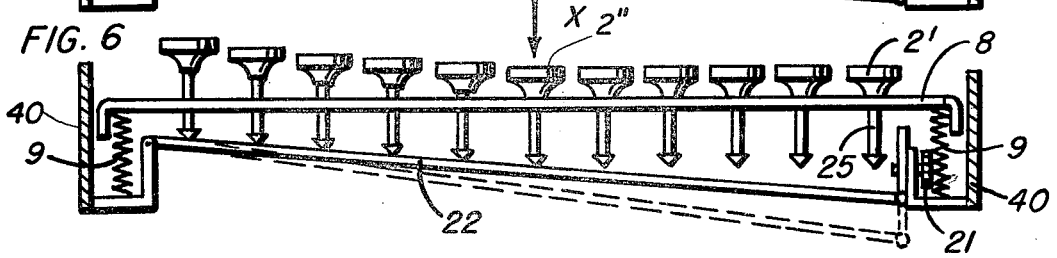
FIG. 6 is a view the same as that of FIG. 5 but diagrammatically illustrating the condition assumed when one of the keys illustrated in FIG. 5 is depressed.

FIG. 6 shows the keyboard 2 during movement. The keys 2' of the keyboard 2 are mounted on plate 8 but are held or supported loosely thereon. At arrow X a key 2'' is depressed. The keys 2' to the left of depressed key 2'' are moved upwardly relative to plate 8 by inclined lever 22, while keys 2' to the right of depressed key 2'' move with plate 8 since their stems 25 never engage inclined lever 22.

If one desires the lever 22 to be horizontally fixed, i.e., not variable, the stems 25 of the keys 2' must be progressively one shorter than the other. For typewriting on the staff diagrams 26 of various heights it is necessary for the fulcrum (device 10) to be moved. In those machines which have the characters carried by a ball, one can provide one half of the ball with the capital letters, numbers and orthographic signs while the other half of the ball carries the notes and the musical signs. Thus there is one set of type for typewriting the words and another set of type for typewriting the musical notations provided all on a single ball.

What I claim is:

1. In a type bar typewriter including a carriage mounted for reciprocation, an elongated cylindrical platen means journaled in the carriage for rotation about a longitudinal axis for receiving sheet material to be imprinted, disengageable means for effecting step-wise rotation of the platen means, a primary character keyboard and character type bar means for imprinting characters on the sheet material, the improvement comprising platen positioning means operable during disengagement of the platen step-wise rotation means for incrementally rotating the platen means for advancing the sheet material to a desired type bar imprinting location relative to a musical staff imprinted on the sheet material, said platen positioning means comprising frame means, means mounted said frame means on the typewriter for pivotal movement, said frame means including a pair of spaced generally parallel coextensive supports, a bridging member secured to said supports at one end thereof, a secondary musical notation keyboard means secured to said supports at the other end thereof and including a plurality of depressible keys, each key representing a different imprinting location, roller means in driving relation to said platen means, said bridging member including means for rotating the roller means and the platen means in response to depression of a secondary musical notation keyboard means.

2. A structure as claimed in claim 1 wherein said secondary musical notation keyboard means comprises a lever, each of said keys including a depending stem engageable with said lever when the key is depressed, whereby to cause the frame means to be pivoted.

3. A structure as claimed in claim 2 wherein said lever is inclined and the stems are all the same length.

4. The structure as claimed in claim 1 and a scribing device operably arranged relative to the platen means for applying an imprint of a musical staff to the sheet material and comprising well defining means, shaft means seated across the well defining means and wheel means carried by said shaft means and arranged for transport through said well defining means, ink carrying resilient material seated within said well defining means for transferring ink to said wheel means as the wheel means are transported through said well defining means, said wheel means arranged to engage the sheet material during said transport and means to effect said transport.

5. The structure as claimed in claim 4 wherein said scribing device is moved relative to said sheet material.

6. The structure as claimed in claim 4 wherein said platen means is moved relative to the said scribing device for imprinting the musical notation staff.

* * * * *